US009388700B2

(12) United States Patent
Propheter-Hinckley et al.

(10) Patent No.: US 9,388,700 B2
(45) Date of Patent: Jul. 12, 2016

(54) GAS TURBINE ENGINE AIRFOIL COOLING CIRCUIT

(75) Inventors: Tracy A. Propheter-Hinckley, Manchester, CT (US); Edward F. Pietraszkiewicz, Southington, CT (US); Rafael A. Perez, Arecibo, PR (US); Anton G. Banks, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 986 days.

(21) Appl. No.: 13/421,894

(22) Filed: Mar. 16, 2012

(65) Prior Publication Data

US 2013/0243591 A1 Sep. 19, 2013

(51) Int. Cl.
*F01D 5/18* (2006.01)

(52) U.S. Cl.
CPC ..... *F01D 5/187* (2013.01); *F05D 2240/12* (2013.01); *F05D 2250/185* (2013.01); *F05D 2260/205* (2013.01); *F05D 2260/2212* (2013.01); *F05D 2260/22141* (2013.01)

(58) Field of Classification Search
USPC ..... 415/115; 416/97 R
See application file for complete search history.

(56) References Cited

U.S. PATENT DOCUMENTS 4,416,585 A * 11/1983 Abdel-Messeh ..... 416/97 R
4,514,144 A * 4/1985 Lee ..... 416/96 R
4,775,296 A 10/1988 Schwarzmann et al.
5,052,889 A 10/1991 Abdel-Messeh
5,395,212 A * 3/1995 Anzai et al. ..... 416/97 R
5,681,144 A * 10/1997 Spring et al. ..... 416/97 R
5,695,321 A 12/1997 Kercher
6,056,508 A 5/2000 Johnson et al.
6,068,445 A * 5/2000 Beeck et al. ..... 416/96 R
6,183,194 B1 * 2/2001 Cunha et al. ..... 415/115
6,290,462 B1 * 9/2001 Ishiguro et al. ..... 416/97 R
6,331,098 B1 * 12/2001 Lee ..... 416/97 R
6,406,260 B1 6/2002 Trindade et al.
6,974,308 B2 12/2005 Halfmann et al.
7,094,031 B2 * 8/2006 Lee et al. ..... 416/97 R
7,637,720 B1 * 12/2009 Liang ..... 416/96 R
8,083,485 B2 12/2011 Chon et al.

(Continued)

FOREIGN PATENT DOCUMENTS

DE 10316909 A1 11/2003
EP 0527554 A1 2/1993

(Continued)

OTHER PUBLICATIONS

International Search Report and Written Opinion for International Application No. PCT/US2013/029289 dated Jun. 13, 2013.

(Continued)

*Primary Examiner* — Dwayne J White
*Assistant Examiner* — Aaron R Eastman
(74) *Attorney, Agent, or Firm* — Carlson, Gaskey & Olds

(57) ABSTRACT

An airfoil for a gas turbine engine according to one exemplary embodiment includes an airfoil body that extends between a leading edge and a trailing edge. A cooling circuit can be defined within the airfoil body. The cooling circuit can include at least one trip strip disposed within a cavity of the cooling circuit between a leading edge inner wall and a first rib. The at least one trip strip can include an increasing height in a direction from the first rib toward the leading edge inner wall.

21 Claims, 7 Drawing Sheets

(56) References Cited

U.S. PATENT DOCUMENTS

| | | | | |
|---|---|---|---|---|
| 2002/0028140 | A1* | 3/2002 | Jacala | 416/96 R |
| 2003/0108422 | A1* | 6/2003 | Merry | 416/97 R |
| 2006/0051208 | A1* | 3/2006 | Lee et al. | 416/97 R |
| 2006/0239820 | A1* | 10/2006 | Kizuka et al. | 416/97 R |
| 2008/0286115 | A1 | 11/2008 | Liang | |
| 2009/0074575 | A1 | 3/2009 | Propheter-Hinckley et al. | |
| 2009/0104035 | A1* | 4/2009 | Abdel-Messeh et al. | 416/95 |
| 2010/0126960 | A1* | 5/2010 | Cunha | 216/37 |
| 2011/0286857 | A1 | 11/2011 | Gleiner et al. | |

FOREIGN PATENT DOCUMENTS

| | | | |
|---|---|---|---|
| EP | 0892149 | A1 | 1/1999 |
| EP | 0892150 | A1 | 1/1999 |
| EP | 1637699 | A2 | 3/2006 |
| GB | 2112467 | A | 7/1983 |

OTHER PUBLICATIONS

International Preliminary Report on Patentability for International Application No. PCT/US2013/029289 dated Sep. 25, 2014.

Intellectual Property Office of Singapore, Search Report and Written Opinion for Patent Application No. 11201405597P dated Mar. 11, 2015.

Extended European Search Report for Application No. EP 13 76 2007 dated Feb. 25, 2016.

* cited by examiner

GAS TURBINE ENGINE AIRFOIL COOLING CIRCUIT

BACKGROUND

This disclosure relates to a gas turbine engine, and more particularly to an airfoil cooling circuit that includes at least one trip strip to cool an airfoil of a gas turbine engine.

Gas turbine engines typically include a compressor section, a combustor section and a turbine section. In general, during operation, air is pressurized in the compressor section and mixed with fuel and burned in the combustor section to generate hot combustion gases. The hot combustion gases flow through the turbine section which extracts energy from the hot combustion gases to power the compressor section and other gas turbine engine loads.

The compressor and turbine sections of the gas turbine engine typically include alternating rows of rotating blades and stationary vanes. The rotating blades extract the energy from the hot combustion gases that are communicated through the gas turbine engine, and the vanes convert the velocity of the airflow into pressure and prepare the airflow for the next set of blades. The hot combustion gases are communicated over airfoils of the blades and vanes. The airfoils can include cooling circuits that receive cooling airflow for cooling the airfoils during engine operation.

SUMMARY

An airfoil for a gas turbine engine according to one exemplary embodiment includes an airfoil body that extends between a leading edge and a trailing edge. A cooling circuit can be defined within the airfoil body. The cooling circuit can include at least one trip strip disposed within a cavity of the cooling circuit between a leading edge inner wall and a first rib. The at least one trip strip can include an increasing height in a direction from the first rib toward the leading edge inner wall.

In a further embodiment of the foregoing airfoil embodiment, the airfoil can be a blade.

In a further embodiment of either of the foregoing airfoil embodiments, the airfoil can be a vane.

In a further embodiment of any of the foregoing airfoil embodiments, the cavity can extend between a suction side inner wall and a pressure side inner wall.

In a further embodiment of any of the foregoing airfoil embodiments, the increasing height can extend in a direction from one of the suction side inner wall and the pressure side inner wall toward the other of the suction side inner wall and the pressure side inner wall.

In a further embodiment of any of the foregoing airfoil embodiments, at least one trip strip can include a leading edge portion adjacent the leading edge inner wall and a trailing edge portion adjacent to the first rib.

In a further embodiment of any of the foregoing airfoil embodiments, the leading edge portion can be generally perpendicular to the leading edge inner wall.

In a further embodiment of any of the foregoing airfoil embodiments, a gap can extend between the leading edge portion and the leading edge inner wall.

In a further embodiment of any of the foregoing airfoil embodiments, the at least one trip strip can be hockey stick shaped.

In a further embodiment of any of the foregoing airfoil embodiments, the at least one trip strip can include at least two trip strips that are arranged in a V-shaped chevron configuration.

In a further embodiment of any of the foregoing airfoil embodiments, the at least two trip strips are staggered along the cavity of the cooling circuit.

In a further embodiment of any of the foregoing airfoil embodiments, the at least on trip strip can include at least a first trip strip and a second trip strip having a different configuration from the first trip strip.

In a further embodiment of any of the foregoing airfoil embodiments, the first trip strip and the second trip strip can be non-symmetrically arranged relative to a mean camber line of the cavity of the cooling circuit.

A gas turbine engine according to another exemplary embodiment includes a compressor section, a combustor section in fluid communication with said compressor section, a turbine section in fluid communication said combustor section, an airfoil disposed in at least one of the compressor section and the turbine section. The airfoil can include an airfoil body that extends between a leading edge and a trailing edge. A cooling circuit can be disposed within the airfoil body and have a cavity adjacent to the leading edge. The cavity can include a leading edge inner wall, a suction side inner wall and a pressure side inner wall. A trip strip can include a leading edge portion that extends a first distance from at least one of the suction side inner wall and the pressure side inner wall and a trailing edge portion can extend a second distance from at least one of the suction side inner wall and the pressure side inner wall. The first distance can be greater than said second distance.

In a further embodiment of the foregoing gas turbine engine embodiment, the leading edge portion can be adjacent to the leading edge inner wall and the trailing edge portion can be adjacent to a rib of the cavity.

In a further embodiment of either of the foregoing gas turbine engine embodiments, the leading edge portion can be generally perpendicular to the leading edge inner wall.

In a further embodiment of any of the foregoing gas turbine engine embodiments, the gas turbine engine is a land based gas turbine engine.

In a further embodiment of any of the foregoing gas turbine engine embodiments, the gas turbine engine is a turbofan gas turbine engine.

A method for cooling an airfoil of a gas turbine engine according to yet another exemplary embodiment includes communicating a cooling airflow through a cavity of a cooling circuit of the airfoil, and directing a first portion of the cooling airflow axially along an upstream face of at least one trip strip of the cooling circuit toward a leading edge of the airfoil to cool the leading edge of the airfoil.

In a further embodiment of the foregoing method embodiment, a gap can be provided between a leading edge inner wall of the airfoil and a leading edge portion of the at least one trip strip.

In a further embodiment of either of the foregoing method embodiments, a second portion of the cooling airflow can be directed across a height of the at least one trip strip.

The various features and advantages of this disclosure will become apparent to those skilled in the art from the following detailed description. The drawings that accompany the detailed description can be briefly described as follows.

DETAILED DESCRIPTION

Figure 1:
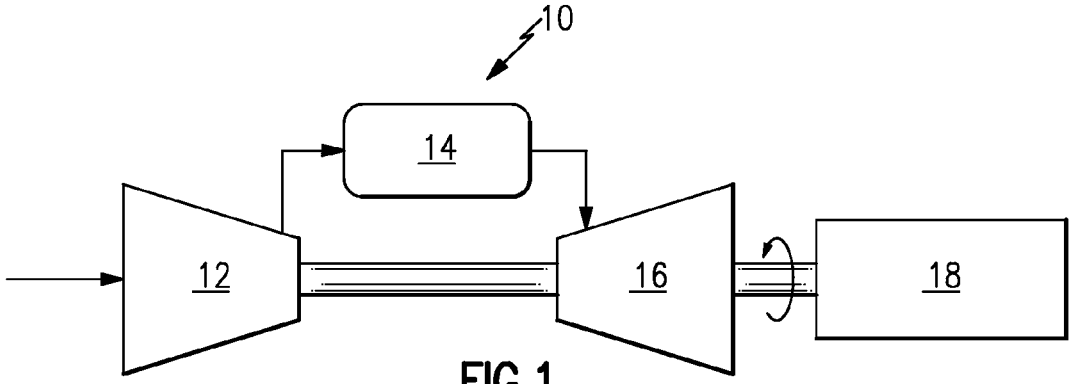
FIG. 1 schematically illustrates a gas turbine engine.

FIG. 1 schematically illustrates a gas turbine engine 10. The example gas turbine engine 10 may be a land based gas turbine engine that generally incorporates a compressor section 12, a combustor section 14, a turbine section 16 and a generator 18. Alternative engines could include fewer or additional sections, systems or features. Generally, the compressor section 12 drives air along a core flow path for compression and communication into the combustor section 14. The hot combustion gases generated in the combustor section 14 are expanded through the turbine section 16, which extracts energy from the hot combustion gases to power the compressor section 12 and the generator 18.

This view is highly schematic and is included only to provide a basic understanding of a gas turbine engine and not to limit the disclosure. This disclosure extends to all types of gas turbine engines and to all types of applications, including but not limited to, multiple spool turbofan engines that can incorporate a fan section. This disclosure could also extend to flight engines, auxiliary power units, or power generation units.

The compressor section 12 and the turbine section 16 can each include alternating rows of rotor assemblies and vane assemblies (not shown). The rotor assemblies carry a plurality of rotating blades, while each vane assembly includes a plurality of vanes. The blades of the rotor assemblies create or extract energy (in the form of pressure) from core airflow that is communicated through the gas turbine engine 10. The vanes of the vane assemblies direct airflow to the blades of the rotor assemblies to either add or extract energy.

Various components of the gas turbine engine 10, including airfoils such as the blades and vanes of the compressor section 12 and the turbine section 16, may be subjected to repetitive thermal cycling under widely ranging temperatures and pressures. The hardware of the turbine section 16 is particularly subjected to relatively extreme operating conditions. Therefore, some components may require internal cooling circuits for cooling the parts during engine operation. Example cooling circuits that include features such as trip strips for cooling these components are discussed below.

Figure 2:
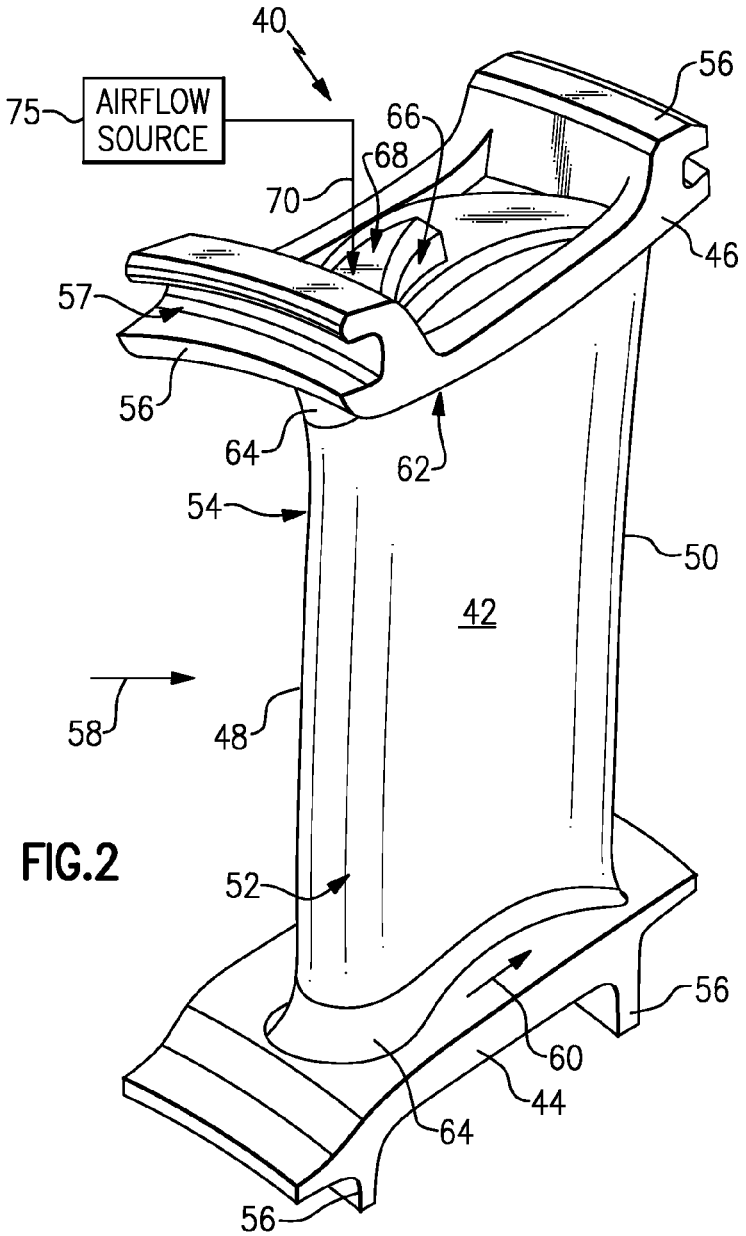
FIG. 2 illustrates an airfoil of a gas turbine engine.

FIG. 2 illustrates an airfoil 40 that can be incorporated into a gas turbine engine, such as the gas turbine engine 10 of FIG. 1. In this example, the airfoil 40 is a vane of a vane assembly of either the compressor section 12 or the turbine section 16. However, the teachings of this disclosure are not limited to vane airfoils and could extend to other airfoils including blades and also non-airfoil hardware of the gas turbine engine 10. This disclosure could also extend to airfoils of a middle turbine frame of a gas turbine engine.

The airfoil 40 includes an airfoil body 42 that extends between an inner platform 44 (on an inner diameter side) and an outer platform 46 (on an outer diameter side). The airfoil 40 also includes a leading edge 48, a trailing edge 50, a pressure side 52 and a suction side 54. The airfoil body 42 extends in chord between the leading edge 48 and the trailing edge 50.

Both the inner platform 44 and the outer platform 46 include leading and trailing edge rails 56 having one or more engagement features 57 for mounting the airfoil 40 to the gas turbine engine 10, such as to an engine casing. Other engagement feature configurations are contemplated as within the scope of this disclosure, including but not limited to, hooks, rails, bolts, rivets and tabs that can be incorporated into the airfoil 40 to retain the airfoil 40 to the gas turbine engine 10.

A gas path 58 is communicated axially downstream through the gas turbine engine 10 in a direction that extends from the leading edge 48 toward the trailing edge 50 of the airfoil body 42. The gas path 58 (for the communication of core airflow along a core flow path) extends between an inner gas path 60 associated with the inner platform 44 and an outer gas path 62 associated with the outer platform 46 of the airfoil 40. The inner platform 44 and the outer platform 46 are connected to the airfoil 40 at the inner and outer gas paths 60, 62 via fillets 64.

The airfoil body 42 includes an internal circuit 66 having an inlet 68 that receives a cooling airflow 70 from an airflow source 75 that is external to the airfoil 40. In this embodiment, the inlet 68 of the internal circuit 66 is positioned at the outer platform 46 of the airfoil 40, although the inlet 68 could also be positioned at the inner platform 44. The cooling airflow 70 is a lower temperature than the airflow of the gas path 58 that is communicated across the airfoil body 42. In one example, the cooling airflow 70 is a bleed airflow that can be sourced from the compressor section 12 or any other portion of the gas turbine engine 10 that is upstream from the airfoil 40. The cooling airflow 70 is circulated through a cooling circuit 72 (See FIGS. 3-6) of the airfoil 40 to transfer thermal energy from the airfoil 40 to the cooling airflow 70 thereby cooling portions of the airfoil 40.

A cooling circuit such as disclosed herein can be disposed in any component that requires cooling, including but not limited to those components that are exposed to the gas path 58 of the gas turbine engine 10. In the illustrated embodiments and for the purpose of providing detailed examples, the cooling circuits of this disclosure are disposed within a portion of an airfoil, such as a stator vane or a rotor blade. It should be understood, however, that the cooling circuits are not limited to these applications and could be utilized within other areas of the gas turbine engine that are exposed to relatively extreme environments, including but not limited to blade outer air seals (BOAS) and platforms.

Figure 3:
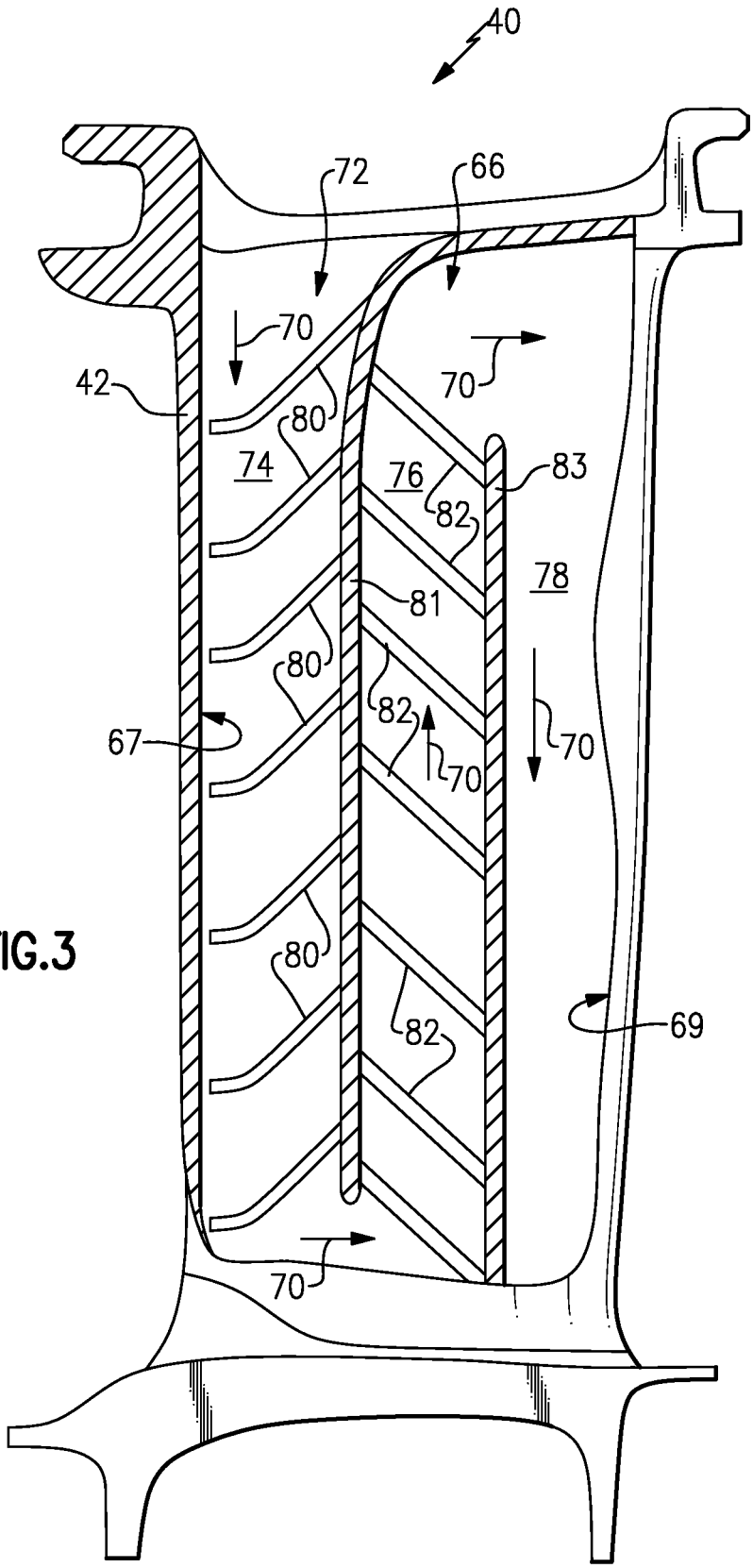
FIG. 3 illustrates a cut away view of an airfoil having a cooling circuit.

FIG. 3 illustrates an example cooling circuit 72 of an airfoil 40. The cooling circuit 72 is defined inside of the airfoil body 42. In this example, the cooling circuit 72 establishes a multi-pass cooling passage within the internal circuit 66 of the airfoil body 42. Although a three-pass cooling circuit is depicted by FIG. 3, it should be understood that the cooling circuit 72 could include any number of passes. For example, a two-pass or four-pass cooling passage could be incorporated into the airfoil 40. Also, although the cooling circuit 72 of this example is defined in the radial direction, it should be understood that this disclosure could also extend to a cooling circuit that extends in the tangential direction.

The example cooling circuit 72 includes a first cavity 74 (i.e., a leading edge cavity), a second cavity 76 (i.e., an intermediate cavity), and a third cavity 78 (i.e., a trailing edge cavity). The cavities 74, 76, 78 direct the cooling airflow 70 through the cooling circuit 72 to cool any high temperature areas of the airfoil body 42. The first cavity 74 is in fluid communication with the second cavity 76, and the second cavity 76 is in fluid communication with the third cavity 78. Accordingly, the cooling airflow 70 received within the cooling circuit 72 can be circulated through the first cavity 74, then through the second cavity 76, and then through the third cavity 78 to cool the airfoil 40. Also, the cooling airflow 70 could be communicated in the opposite direction (in a direction from the inner platform 44 toward the outer platform 46) within the scope of this disclosure.

A first rib 81 separates the first cavity 74 from the second cavity 76, and a second rib 83 divides the second cavity 76 from the third cavity 78. The first and second ribs 81, 83 extend generally parallel to a longitudinal axis of the airfoil 40.

The internal circuit 66 of the airfoil 40 establishes a leading edge inner wall 67 and a trailing edge inner wall 69. The cooling circuit 72 extends axially between the leading edge inner wall 67 and the trailing edge inner wall 69.

One or more trip strips 80 can be disposed within the first cavity 74 of the cooling circuit 72 between the first rib 81 and the leading edge inner wall 67. In this example, the trips strips 80 include a hockey stick shape. In other words, a leading edge portion 90 is transverse to a trailing edge portion 92 of the trip strip (See FIG. 6). One or more trip strips 82 can also be disposed within the second cavity 76 (angled between the first rib 81 and the second rib 83) and the third cavity 78. The trip strips 80, 82 create turbulence in the cooling airflow 70 as it is communicated through the cooling circuit 72 to improve the heat transfer between the cooling airflow 70 and the airfoil 40. In this example, the trip strips 80 are disposed in the first cavity 74, the trip strips 82 having a slightly different configuration than the trip strips 80 are disposed within the second cavity 76, and no trip strips are positioned in the third cavity 78. The actual number and configuration of the trip strips 80, 82 can vary depending upon design specific parameters, including but not limited to the cooling requirements of the airfoil 40. For example, the cooling circuit 72 could include only the trip strips 80 in the first cavity 74.

Figure 4:
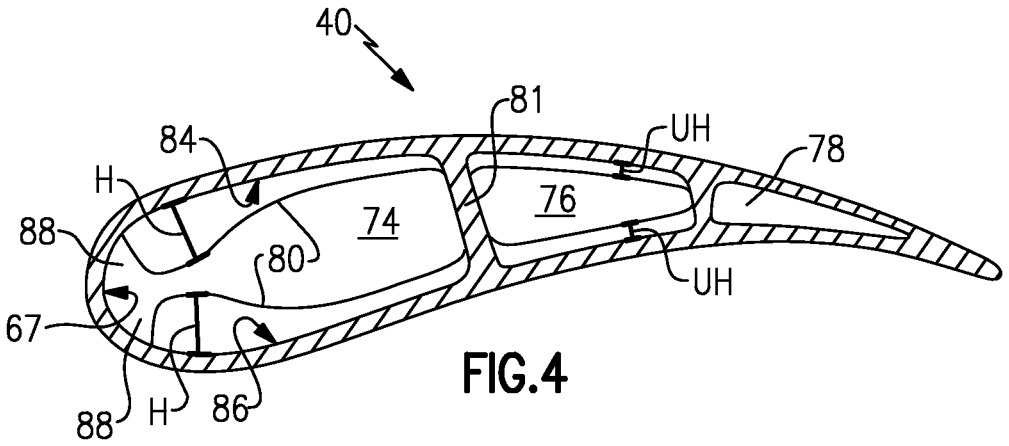
FIG. 4 illustrates a cross-sectional view of an airfoil.

Referring to FIG. 4, the trip strips 80 of the cooling circuit 72 can extend from a suction side inner wall 84 and/or a pressure side inner wall 86 of the first cavity 74 of the cooling circuit 72. The first cavity 74 extends between the suction side inner wall 84 and the pressure side inner wall 86. The trip strips 80 can include an increasing height H that increases in a direction extending from the first rib 81 toward the leading edge inner wall 67. The height H extends in a direction from either the suction side inner wall 84 or the pressure side inner wall 86 toward the opposite wall (i.e., the height H extends into the first cavity 74). A gap 88 extends between the trip strips 80 and the leading edge inner wall 67. In other words, the trip strips 82 may not span the entire distance between the leading edge inner wall 67 and the first rib 81. The trip strips 82 of the second cavity 76 can include a uniform height UH.

Figure 5:
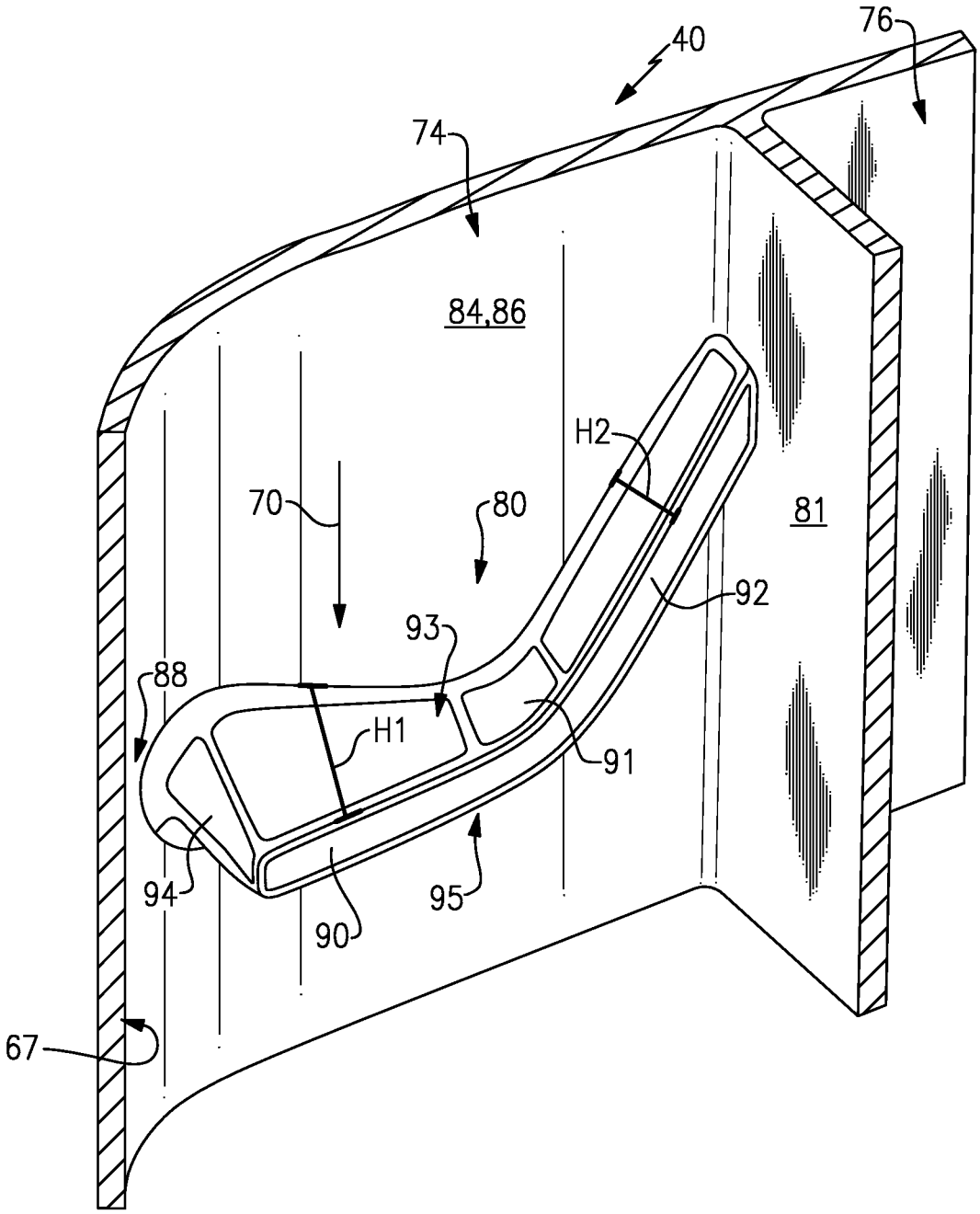
FIG. 5 illustrates an example trip strip that can be incorporated into a cooling circuit of an airfoil.

FIG. 5 illustrates an example trip strip 80 that can be disposed within one or more of the cavities 74, 76, 78 of the cooling circuit 72 of an airfoil 40. In this example, the trip strip 80 is disposed within the first cavity 74, although one or more trip strips 80 could be disposed in any or all of the cavities 74, 76 and 78.

The example trip strip 80 includes a leading edge portion 90 that is adjacent to the leading edge inner wall 67 and a trailing edge portion 92 that is adjacent to the first rib 81 that divides the first cavity 74 from the second cavity 76. The trip strip 80 can extend between the leading edge inner wall 67 and the first rib 81, while a gap 88 can extend between a tip 94 of the leading edge portion 90 and the leading edge inner wall 67 to force cooling airflow 70 to impinge on the leading edge inner wall 67 without obstructing forward flow of the cooling airflow 70.

The trip strip 80 includes an increasing height in a direction from the first rib 81 toward the leading edge inner wall 67. In this example, the leading edge portion 90 extends a first distance H1 from the suction side inner wall 84 (or pressure side inner wall 86) and the trailing edge portion 92 of the trip strip 80 extends a second distance H2 from the suction side inner wall 84 (or pressure side inner wall 86). The first distance H1 is greater than the second distance H2, in one exemplary embodiment.

In this exemplary embodiment, the trailing edge portion 92 is angled relative to the leading edge portion 90. A transition portion 91 can transition the leading edge portion 90 into the trailing edge portion 92. The leading edge portion 90 can be generally perpendicular to the leading edge inner wall 67, and the trailing edge portion 92 can be generally transverse to the first rib 81 and the leading edge inner wall 67.

The trip strip 80 also includes an upstream face 93 and a downstream face 95 opposite from the upstream face 93. The upstream face 93 faces the oncoming cooling airflow 70 as the cooling airflow 70 is communicated through the cooling circuit 72.

Figure 6:
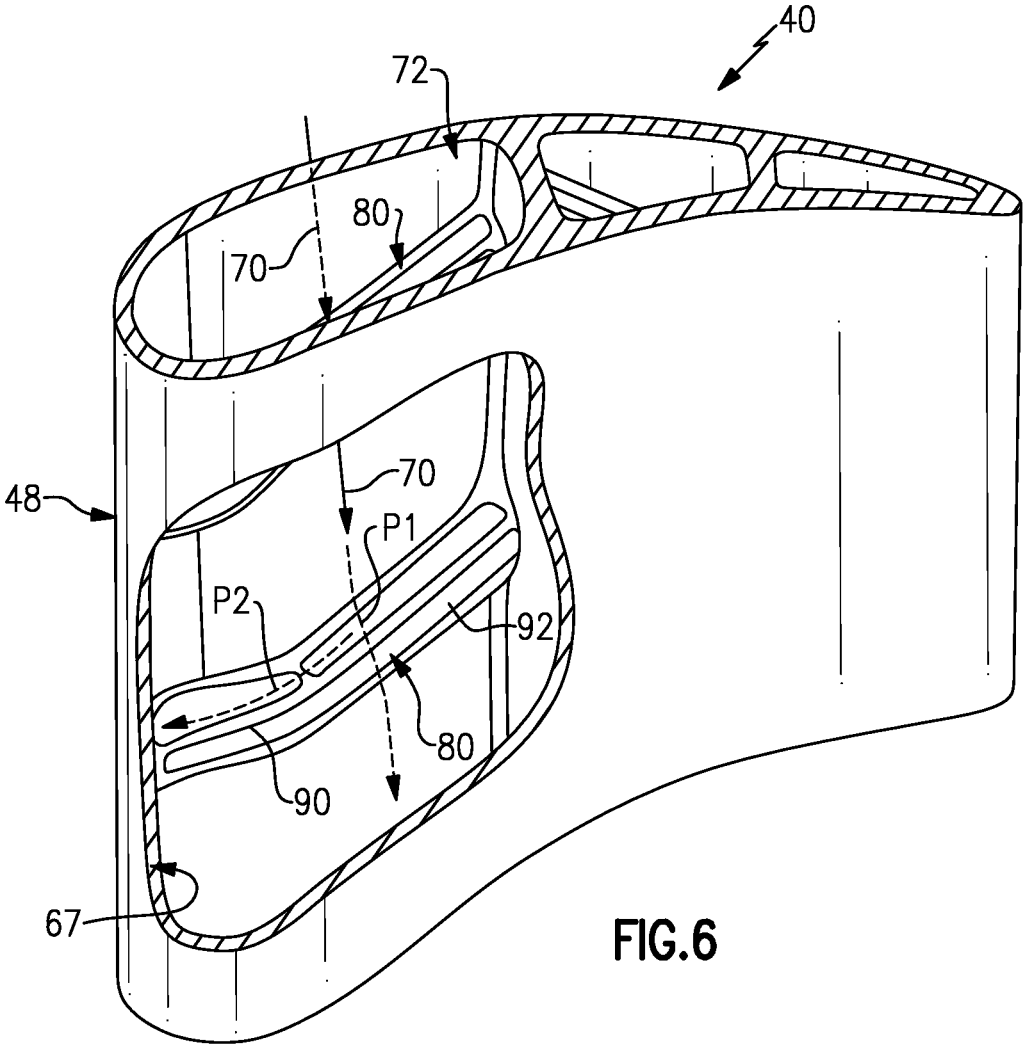
FIG. 6 illustrates a cut away view of a portion of an airfoil.

FIG. 6 illustrates a portion of an airfoil 40, which could include either a vane or a blade. Cooling airflow 70 is communicated through the cooling circuit 72 to cool the airfoil 40. The trip strips 80 create turbulence in the cooling airflow 70 to increase the amount of heat transfer that is achieved between the cooling airflow 70 and the airfoil 40.

For example, a first portion P1 of the cooling airflow 70 can be directed over the height of the trip strips 80, which creates turbulence in the cooling airflow 70. A second portion P2 of the cooling airflow 70 can also be communicated axially along at least a portion of the upstream face 93 of the trip strip 80 to direct the second portion P2 of the cooling airflow 70 toward the leading edge inner wall 67. The trip strips 80 can redirect the momentum of at least a portion of the cooling airflow 70 toward the leading edge inner wall 67, and the increased height H1 (See FIG. 5) of the leading edge portion 90 of the trip strip 80 can direct an increased amount of cooling airflow 70 to the leading edge inner wall 67 to cool the leading edge 48 of the airfoil 40.

Figure 7:
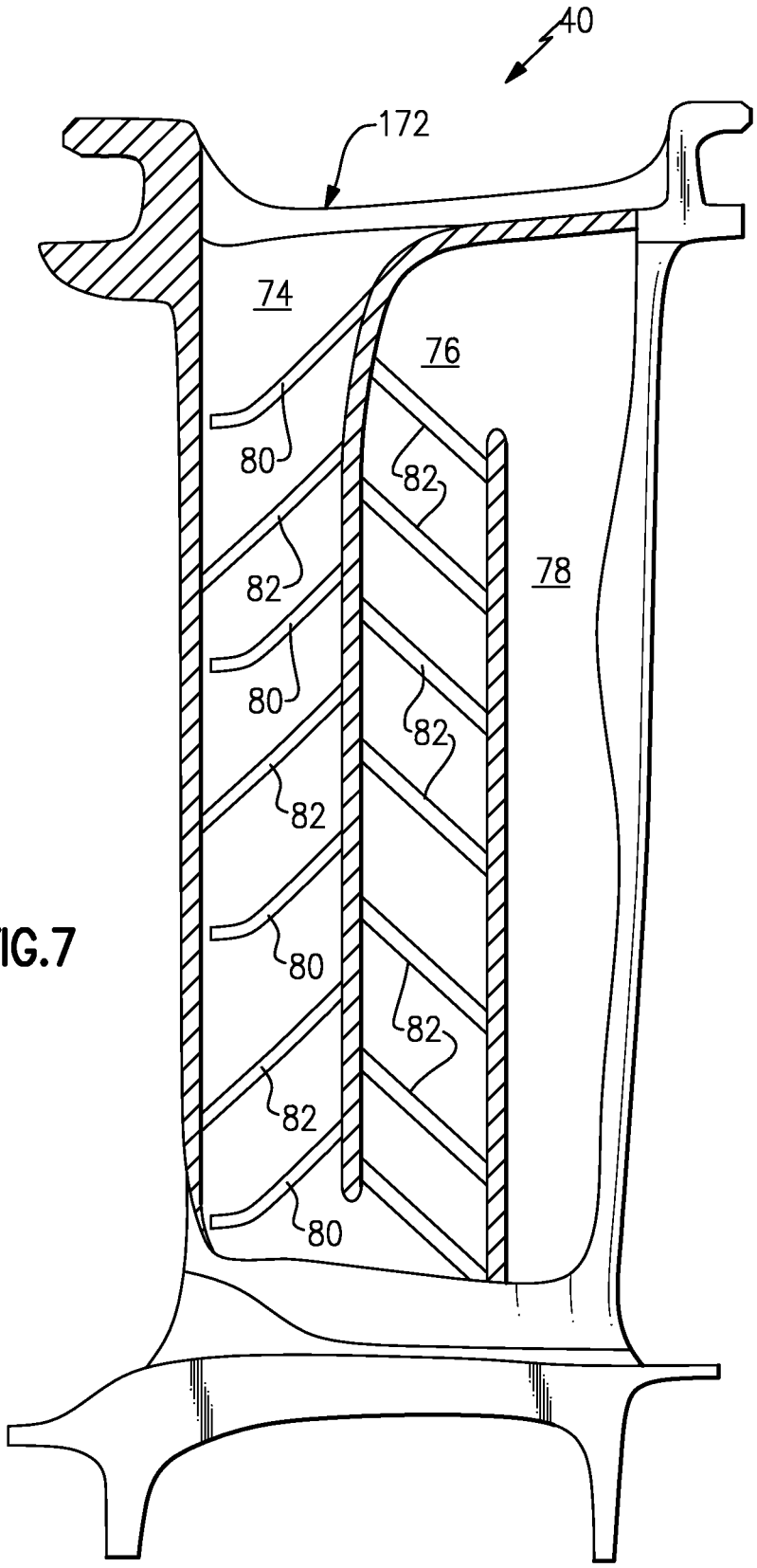
FIG. 7 illustrates another example cooling circuit of an airfoil.

FIG. 7 illustrates another example cooling circuit 172 that can be incorporated into an airfoil 40. In this exemplary embodiment, the first cavity 74 includes both the trip strips 80 having a hockey stick shape and the trip strips 82 having a generally uniform height. The trips strips 80 and the trip strips 82 can be disposed in an alternating pattern. Other configurations and positioning patterns of the trip strips 80 and/or the trip strips 82 are also contemplated as within the scope of this disclosure.

Figure 8:
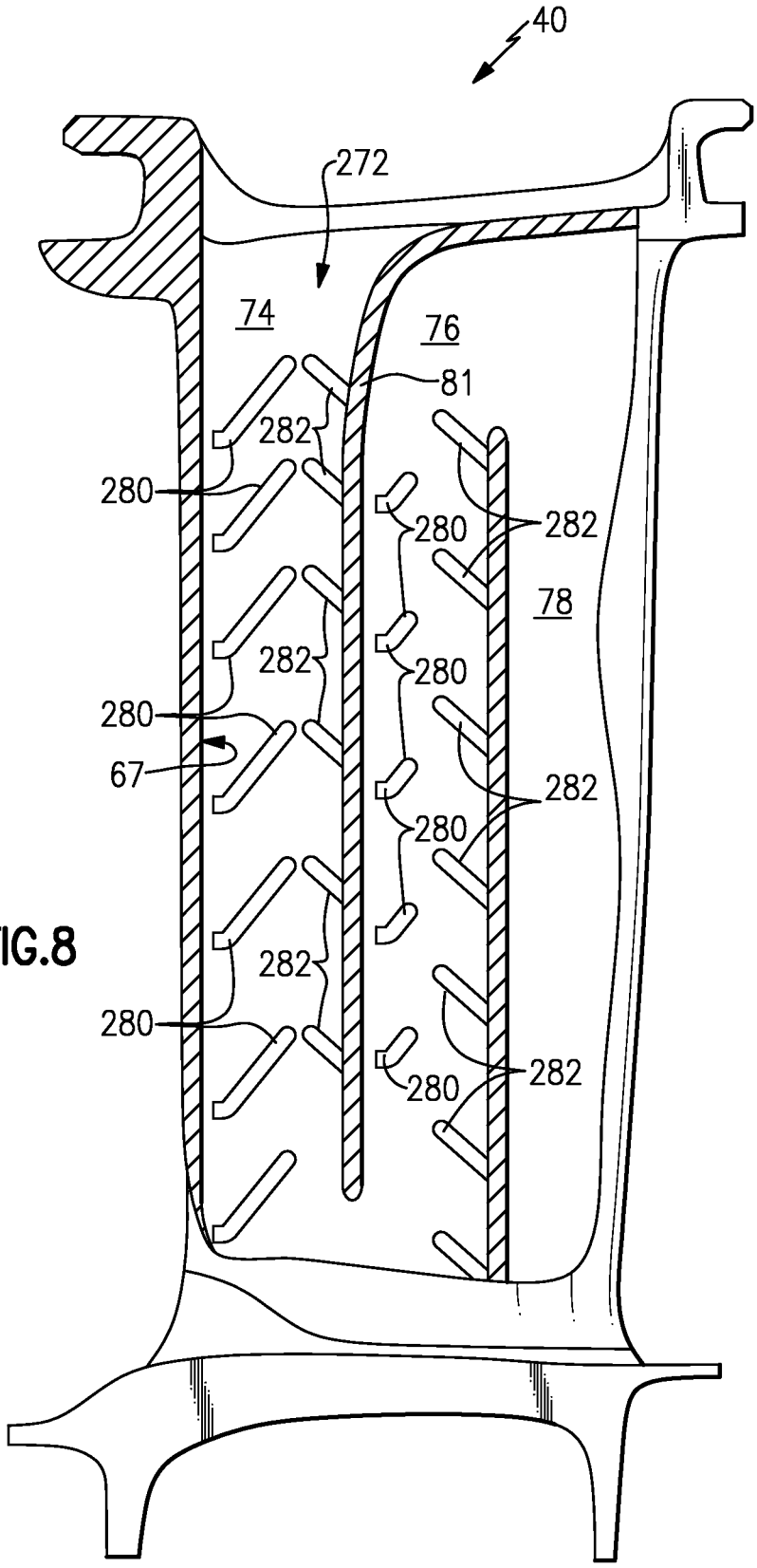
FIG. 8 illustrates another airfoil of a gas turbine engine.
Figure 9:
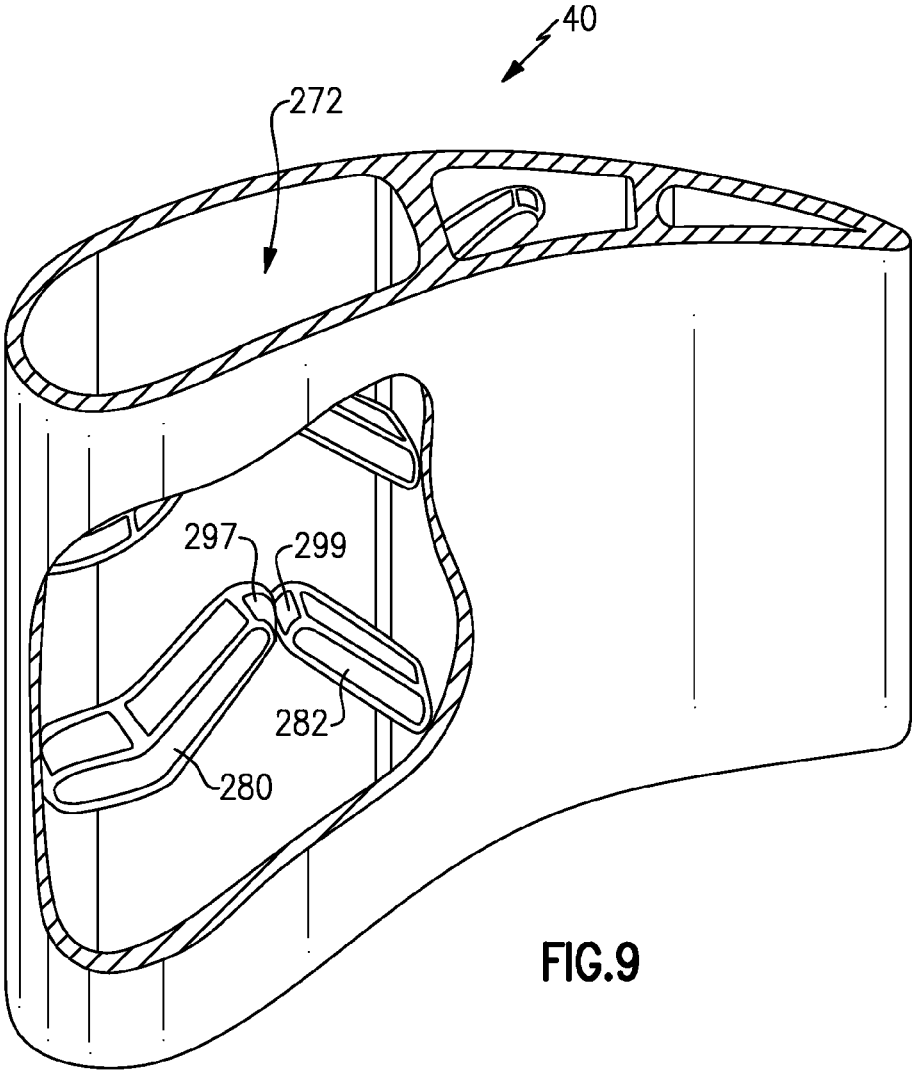
FIG. 9 illustrates a cut away view of portion of an airfoil having a cooling circuit.

FIGS. 8 and 9 illustrate yet another cooling circuit 272 that can incorporated into an airfoil 40. The cooling circuit 272 is substantially similar to the cooling circuit 72 of FIGS. 3-6, except that the cooling circuit 272 includes trip strips 280, 282 (i.e., first and second trip strips) that are configured in a V-shaped or chevron pattern. In this example, the trip strips 280 are hockey stick shaped and have an increasing height in a direction from the first rib 81 toward the leading edge inner wall 67, and the trip strips 282 include a generally uniform height. The trip strips 280 can be disposed adjacent to the leading edge inner wall 67 to direct an increased amount of cooling airflow 70 toward the leading edge inner wall 67, and the trip strips 282 can be disposed adjacent to the first rib 81.

The trip strips 280, 282 could also be longitudinally staggered along one or more of the cavities 74, 76, 78 (shown longitudinally staggered in the second cavity 76 of FIG. 8). Referring to FIG. 9, a trailing most portion 297 of the trip strip 280 can be aligned with a leading most portion 299 of the trip strip 282.

Figure 10:
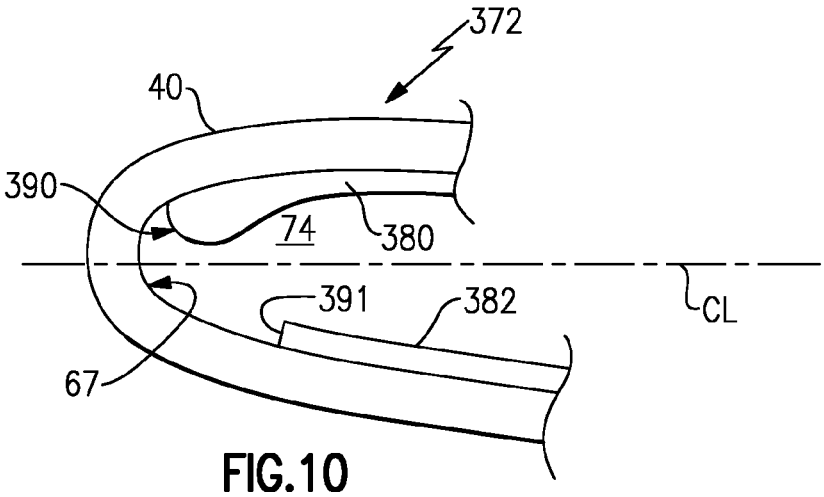
FIG. 10 illustrates a portion of yet another example cooling circuit of an airfoil.

FIG. 10 illustrates a portion of yet another cooling circuit 372 that can be incorporated into an airfoil 40. In this example, trips strips 380, 382 are non-symmetrically arranged relative to a mean camber line CL of a first cavity 74 of the cooling circuit 372. In other words, a leading edge portion 391 of the trip strip 382 is axially offset from a leading edge portion 390 of the trip strip 380 in a direction away from a leading edge inner wall 67 of the airfoil 40. In this example, the trip strip 380 includes a hockey stick shape and has an increasing height in a direction toward the leading edge inner wall 67 and the trip strip 382 includes a generally uniform height. However, it should be understood that the cooling circuit 372 could also utilize only trip strips having a hockey stick shape.

Although the different examples have specific components shown in the illustrations, embodiments of this disclosure are not limited to those particular combinations. It is possible to use some of the components or features from one of the examples in combination with features or components from another one of the examples.

Furthermore, the foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. An airfoil for a gas turbine engine, comprising:

an airfoil body that extends between a leading edge and a trailing edge; and a cooling circuit defined within said airfoil body, wherein said cooling circuit includes at least one trip strip disposed within a cavity of said cooling circuit between a leading edge inner wall and a first rib, wherein said at least one trip strip includes an increasing height in a direction from said first rib toward said leading edge inner wall.

2. The airfoil as recited in claim 1, wherein said airfoil is a blade.

3. The airfoil as recited in claim 1, wherein said airfoil is a vane.

4. The airfoil as recited in claim 1, wherein said cavity extends between a suction side inner wall and a pressure side inner wall and said increasing height extends in a direction from one of said suction side inner wall and said pressure side inner wall toward the other of said suction side inner wall and said pressure side inner wall.

5. The airfoil as recited in claim 1, wherein said at least one trip strip includes a leading edge portion adjacent said leading edge inner wall and a trailing edge portion adjacent to said first rib.

6. The airfoil as recited in claim 5, wherein said leading edge portion is generally perpendicular to said leading edge inner wall.

7. The airfoil as recited in claim 5, wherein a gap extends between said leading edge portion of said at least one trip strip and said leading edge inner wall.

8. The airfoil as recited in claim 1, wherein said at least one trip strip includes a leading edge portion that extends transversely from a trailing edge portion, and said leading edge portion and said trailing edge portion combine to form a hockey stick shape of said at least one trip strip.

9. The airfoil as recited in claim 1, wherein said at least one trip strip includes at least two trip strips that combine to form a V-shaped chevron configuration.

10. The airfoil as recited in claim 9, wherein said at least two trip strips are staggered along said cavity of said cooling circuit.

11. The airfoil as recited in claim 1, wherein said at least one trip strip includes at least a first trip strip and a second trip strip having a different configuration from said first trip strip.

12. The airfoil as recited in claim 11, wherein said first trip strip and said second trip strip are non-symmetrically arranged relative to a mean camber line of said cavity of said cooling circuit.

13. A gas turbine engine, comprising:

a compressor section;

a combustor section in fluid communication with said compressor section;

a turbine section in fluid communication said combustor section;

an airfoil disposed in at least one of said compressor section and said turbine section, wherein said airfoil includes an airfoil body that extends between a leading edge and a trailing edge;

a cooling circuit disposed within said airfoil body and having a cavity adjacent to said leading edge, wherein said cavity includes a leading edge inner wall, a suction side inner wall and a pressure side inner wall; and a trip strip that includes a leading edge portion that extends a first distance from at least one of said suction side inner wall and said pressure side inner wall and a trailing edge portion that extends a second distance from at least one of said suction side inner wall and said pressure side inner wall, wherein said first distance is greater than said second distance such that said leading edge portion extends further toward a center of said cavity than said trailing edge portion.

14. The gas turbine engine as recited in claim 13, wherein said leading edge portion is adjacent to said leading edge inner wall and said trailing edge portion is adjacent to a rib of said cavity.

15. The gas turbine engine as recited in claim 13, wherein said leading edge portion is generally perpendicular to said leading edge inner wall.

16. The gas turbine engine as recited in claim 13, wherein the gas turbine engine is a land based gas turbine engine.

17. The gas turbine engine as recited in claim 13, wherein the gas turbine engine is a turbofan gas turbine engine.

18. A method for cooling an airfoil of a gas turbine engine, comprising the steps of:

communicating a cooling airflow through a cavity of a cooling circuit of the airfoil, the cavity extending between a leading edge inner wall and a first rib; and directing a first portion of the cooling airflow axially along an upstream face of at least one trip strip of the cooling circuit toward a leading edge of the airfoil to cool the leading edge of the airfoil, wherein the at least one trip strip includes an increasing height that increases in a direction that extends from the first rib toward the leading edge inner wall.

19. The method as recited in claim 18, comprising the step of:

providing a gap between the leading edge inner wall of the airfoil and a leading edge portion of the at least one trip strip.

20. The method as recited in claim 18, comprising the step of:

directing a second portion of the cooling airflow across a height of the at least one trip strip.

21. An airfoil for a gas turbine engine, comprising:

an airfoil body that extends between a leading edge and a trailing edge;

a cooling circuit defined inside said airfoil body, wherein said cooling circuit includes a first trip strip disposed within a cavity of said cooling circuit between an inner wall and a first rib; and said first trip strip including a trailing edge portion proximate said first rib and a leading edge portion that extends transversely from said trailing edge portion toward said inner wall, and said leading edge portion terminates prior to said inner wall and includes an increasing height that extends further toward a center of said cavity than said trailing edge portion.

* * * * *